US010222739B2

(12) United States Patent
Wakayama

(10) Patent No.: US 10,222,739 B2
(45) Date of Patent: Mar. 5, 2019

(54) IMAGING FORMING APPARATUS CONFIGURED TO RESTRICT THE ROTATABLE RANGE OF A COVER MEMBER THAT CLOSES OR OPENS AN OPENING OF A HOUSING

(71) Applicant: KYOCERA Document Solutions Inc., Osaka (JP)

(72) Inventor: Kei Wakayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/904,530

(22) Filed: Feb. 26, 2018

(65) Prior Publication Data

US 2018/0253056 A1 Sep. 6, 2018

(30) Foreign Application Priority Data

Mar. 3, 2017 (JP) ..... 2017-040193

(51) Int. Cl.
*G03G 21/16* (2006.01)

(52) U.S. Cl.
CPC ..... *G03G 21/1685* (2013.01); *G03G 21/1633* (2013.01); *G03G 2215/00383* (2013.01); *G03G 2215/00675* (2013.01); *G03G 2221/1639* (2013.01)

(58) Field of Classification Search
CPC ..... G03G 21/1871
USPC ..... 399/90
See application file for complete search history.

(56) References Cited

U.S. PATENT DOCUMENTS 8,200,119 B2 * 6/2012 Okabe ..... B41J 2/471 399/110
8,705,989 B2 * 4/2014 Kawamura ..... B65H 5/062 399/21

FOREIGN PATENT DOCUMENTS

JP 2004-053987 A 2/2004

* cited by examiner

*Primary Examiner* — Quana Grainger
(74) *Attorney, Agent, or Firm* — Studebaker & Brackett PC

(57) ABSTRACT

An image forming apparatus includes a housing, an attachable and detachable device, a cover member, and a rotation angle restricting member. The housing has an opening and an attachment section. The attachable and detachable device is attachable to and detachable from an inside of the housing via the opening. The cover member is rotatably supported by the housing and closes or opens the opening. The rotation angle restricting member restricts an allowable rotation angle that indicates an angle at which the cover member is rotatable. The rotation angle restricting member is attachable to and detachable from the attachment section. The allowable rotation angle of the cover member is restricted when the rotation angle restricting member is attached to the attachment section. Restriction of the allowable rotation angle of the cover member is released when the rotation angle restricting member is detached from the attachment section.

9 Claims, 10 Drawing Sheets

IMAGING FORMING APPARATUS CONFIGURED TO RESTRICT THE ROTATABLE RANGE OF A COVER MEMBER THAT CLOSES OR OPENS AN OPENING OF A HOUSING

INCORPORATION BY REFERENCE

The present application claims priority under 35 U.S.C. § 119 to Japanese Patent Application No. 2017-040193, filed on Mar. 3, 2017. The contents of this application are incorporated herein by reference in their entirety.

BACKGROUND

The present disclosure relates to an image forming apparatus.

An image forming apparatus such as a multifunction peripheral includes a device that has to be replaced periodically (hereinafter referred to as a replacement target device). Some of such replacement target devices are provided inside a housing of the image forming apparatus in an attachable and detachable manner. The housing has an opening via which the replacement target devices are replaced. The opening is covered by an exterior cover attached to the housing in an openable and closable manner. In replacement of the replacement target devices, a user opens the exterior cover and takes the replacement target devices out of the housing via the opening. However, a rotation angle of the exterior cover is typically restricted to less than 90 degrees. Therefore, a large-size replacement target device cannot be replaced by merely opening the exterior cover, and the exterior cover has to be removed from the housing. That is, removal of the exterior cover is added as a process for replacing the large-size replacement target device. In view of the above circumstances, various techniques are proposed to reduce the number of processes required in replacement of replacement target devices. For example, a fixing unit and an exterior cover of an image forming apparatus are formed integrally with each other.

SUMMARY

An image forming apparatus according to the present disclosure includes a housing, an attachable and detachable device, a cover member, and a rotation angle restricting member. The housing has an opening and an attachment section. The attachable and detachable device is attachable to and detachable from an inside of the housing via the opening. The cover member is rotatably supported by the housing and closes and opens the opening. The rotation angle restricting member restricts an allowable rotation angle that indicates an angle at which the cover member is rotatable. The rotation angle restricting member is attachable to and detachable from the attachment section. The allowable rotation angle of the cover member is restricted when the rotation angle restricting member is attached to the attachment section. Restriction of the allowable rotation angle of the cover member is released when the rotation angle restricting member is detached from the attachment section.

DETAILED DESCRIPTION

Figure 1:
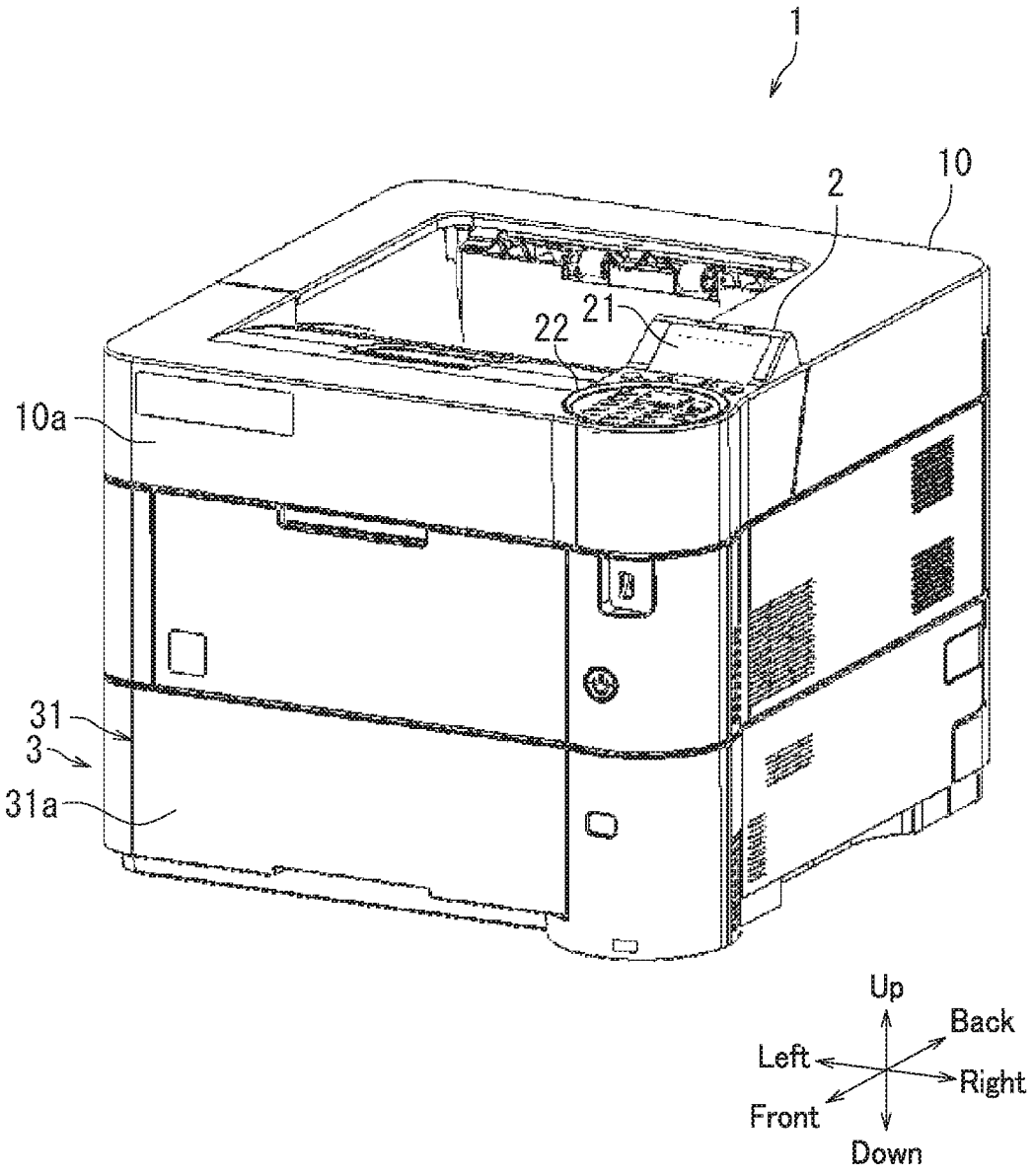
FIG. 1 is a perspective view illustrating external appearance of an image forming apparatus according to an embodiment of the present disclosure.

The following describes an embodiment of an image forming apparatus according to the present disclosure with reference to the drawings. Note that in the drawings, elements that are the same or substantially equivalent are labelled using the same reference signs, and explanation thereof will not be repeated.

First, a configuration of an image forming apparatus 1 according to the present embodiment will be described with reference to FIG. 1. FIG. 1 is a perspective view illustrating external appearance of the image forming apparatus 1 according to the present embodiment. The image forming apparatus 1 in the present embodiment is an electrophotographic printer.

As illustrated in FIG. 1, the image forming apparatus 1 includes a housing 10, an operation panel 2, and a sheet feeder 3. In the following description of the present embodiment, a side of the image forming apparatus 1 on which the operation panel 2 is located is defined as a front side of the image forming apparatus 1, and a side opposite to the front side of the image forming apparatus 1 is defined as a back side thereof. Also, the right side of the image forming apparatus 1 as seen from the front side thereof is defined as a right side of the image forming apparatus 1, and a side opposite to the right side of the image forming apparatus 1 is defined as a left side thereof. Also, a side of the image forming apparatus 1 of the image forming apparatus 1 on which the operation panel 2 is located in a direction perpendicular to a front-back direction and a left-right direction is defined as an upper side of the image forming apparatus 1, and a side opposite to the upper side of the image forming apparatus 1 is defined as a lower side thereof.

The operation panel 2 includes a liquid-crystal display 21 and a plurality of operation keys 22. The operation panel 2 receives an instruction from a user to the image forming apparatus 1.

The sheet feeder 3 is located in a lower part of the housing 10. The sheet feeder 3 includes a cassette 31 as an example of a sheet accommodating device (a detachment restricting member). The cassette 31 is capable of accommodating plural sheets. The cassette 31 is attachable to and detachable from the housing 10. In a state where the cassette 31 is attached to the housing 10, a front surface 31*a* of the cassette 31 and a front surface 10*a* of the housing 10 are flush with each other in the front-back direction.

Note that the image forming apparatus 1 according to the present embodiment further includes devices included in a typical printer, such as a conveyor device, an image forming section, a fixing device, and an ejection device. The conveyor device conveys a sheet accommodated in the cassette 31 from the cassette 31 to the ejection device. The image forming section forms a toner image on the sheet. The image forming section includes a light exposure device, a charger, a photosensitive drum, a developing device, a cleaning device, a transfer device, and the like. The fixing device includes a pressure member and a heating member. The fixing device fixes the toner image to the sheet. The ejection device ejects the sheet with the toner image fixed thereto out of the housing 10.

Figure 2A:
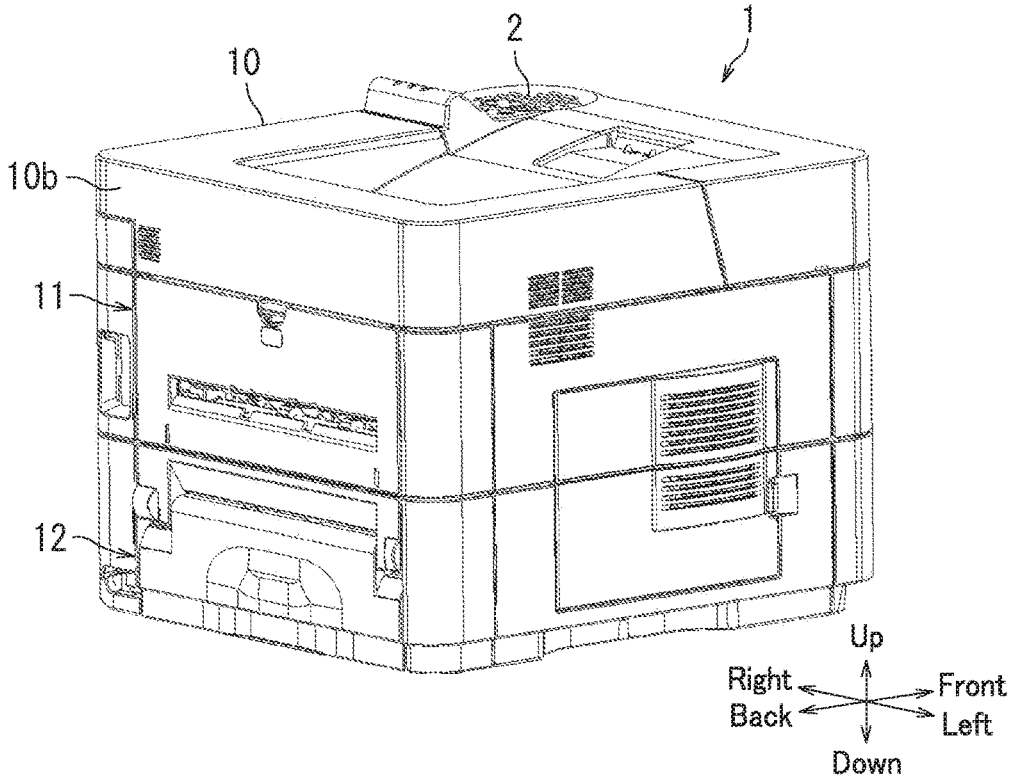
FIG. 2A is a perspective view illustrating external appearance of the back side of the image forming apparatus according to the embodiment of the present disclosure.
Figure 2B:
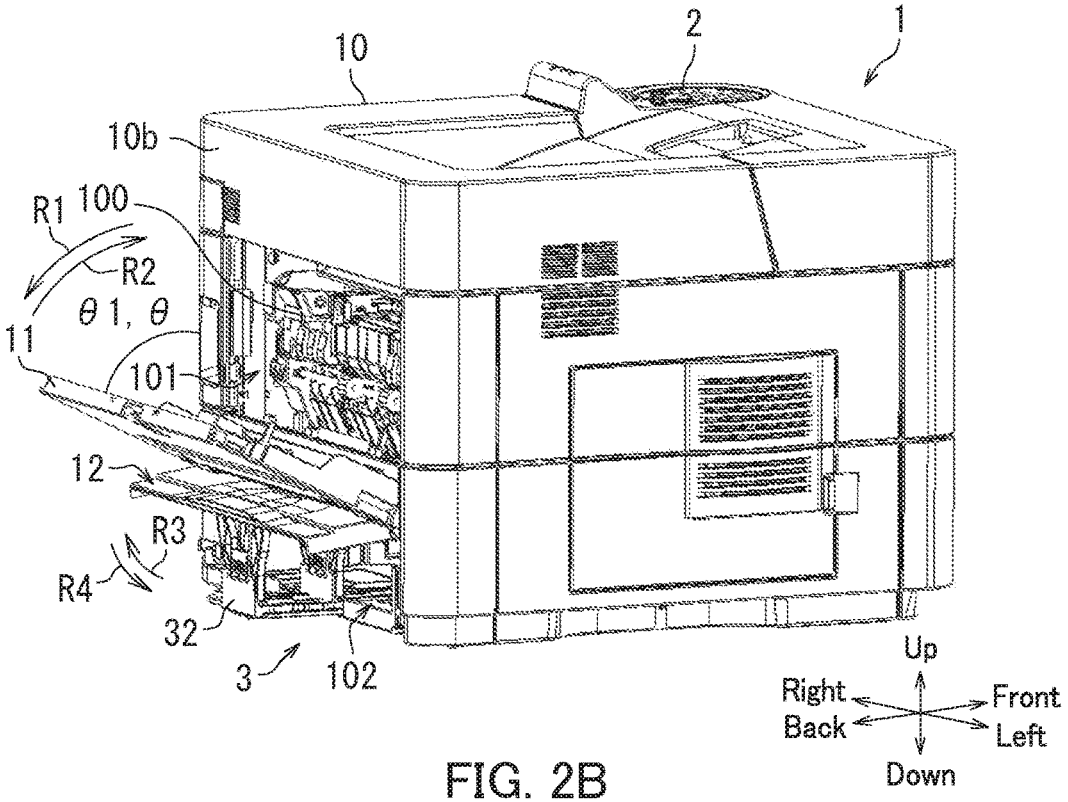
FIG. 2B is a perspective view illustrating external appearance of the back side of the image forming apparatus according to the embodiment of the present disclosure.

Next, a configuration of the back side of the image forming apparatus 1 according to the present embodiment will be described with reference to FIGS. 2A and 2B. FIGS. 2A and 2B are perspective views illustrating external appearance of the back side of the image forming apparatus 1 according to the present embodiment.

As illustrated in FIG. 2A, the housing 10 has a back surface 10*b*. The image forming apparatus 1 further includes a first cover member 11 and a second cover member 12. The first cover member 11 and the second cover member 12 are located on the same side as the back surface 10*b* of the housing 10 and rotatably supported by the housing 10. The first cover member 11 is located above the second cover member 12.

As illustrated in FIG. 2B, the first cover member 11 and the second cover member 12 are openable at the same time. An upper part of the first cover member 11 in the present embodiment opens downwards with a lower part thereof functioning as a pivot. A lower part of the second cover member 12 opens upwards with an upper part thereof functioning as a pivot. When the first cover member 11 is open, a first opening 101 of the housing 10 is exposed. When the second cover member 12 is open, a second opening 102 of the housing 10 is exposed. A fixing device 100 as an example of an attachable and detachable device is provided in an attachable and detachable manner inside the housing 10 in the present embodiment.

The first cover member 11 rotates in a first rotation direction R1 and a second rotation direction R2 illustrated in FIG. 2B. As a result of rotation of the first cover member 11, the first opening 101 is exposed or covered by the first cover member 11. In other words, the first opening 101 is exposed when the first cover member 11 is open, and the first opening 101 is covered by the first cover member 11 when the first cover member 11 is closed. Via the first opening 101 in the present embodiment, the fixing device 100 is attached to and detached from the inside of the housing 10. Also, a sheet causing a jam (a sheet jam) is removed via the first opening 101.

The second cover member 12 rotates in a third rotation direction R3 and a fourth rotation direction R4 illustrated in FIG. 2B. As a result of rotation of the second cover member 12, the second opening 102 is exposed or covered by the second cover member 12. In other words, the second opening 102 is exposed when the second cover member 12 is open, and the second opening 102 is covered by the second cover member 12 when the second cover member 12 is closed. The second cover member 12 opens or closes according to a position of an edge guide 32 included in the sheet feeder 3. Specifically, when the edge guide 32 is located outside the housing 10, the second cover member 12 is open in contact with the edge guide 32. Note that the edge guide 32 is an example of a sheet restricting member.

The image forming apparatus 1 according to the present embodiment includes a rotation angle restricting member. The rotation angle restricting member restricts an allowable rotation angle $\theta_A$ within a range of no less than 0 degree and no greater than a first rotation angle θ1. The allowable rotation angle $\theta_A$ indicates an angle at which the first cover member 11 is rotatable. In other words, in a configuration in which the allowable rotation angle $\theta_A$ is restricted as described above, the first cover member 11 is rotatable up to the first rotation angle θ1. Note that in a state where the first cover member 11 is closed, a rotation angle θ of the first cover member is 0 degree.

As a result of restriction of the allowable rotation angle $\theta_A$ of the first cover member 11, contact (interference) between the first cover member 11 and the second cover member 12 can be prevented even when the first cover member 11 and the second cover member 12 are opened at the same time. Note that in the case of occurrence of a jam, an operator can clear up the jam by opening the first cover member 11 up to the first rotation angle θ1 to remove a sheet from the inside of the housing 10 via the first opening 101. The first rotation angle θ1 is for example 60 degrees.

Figure 3:
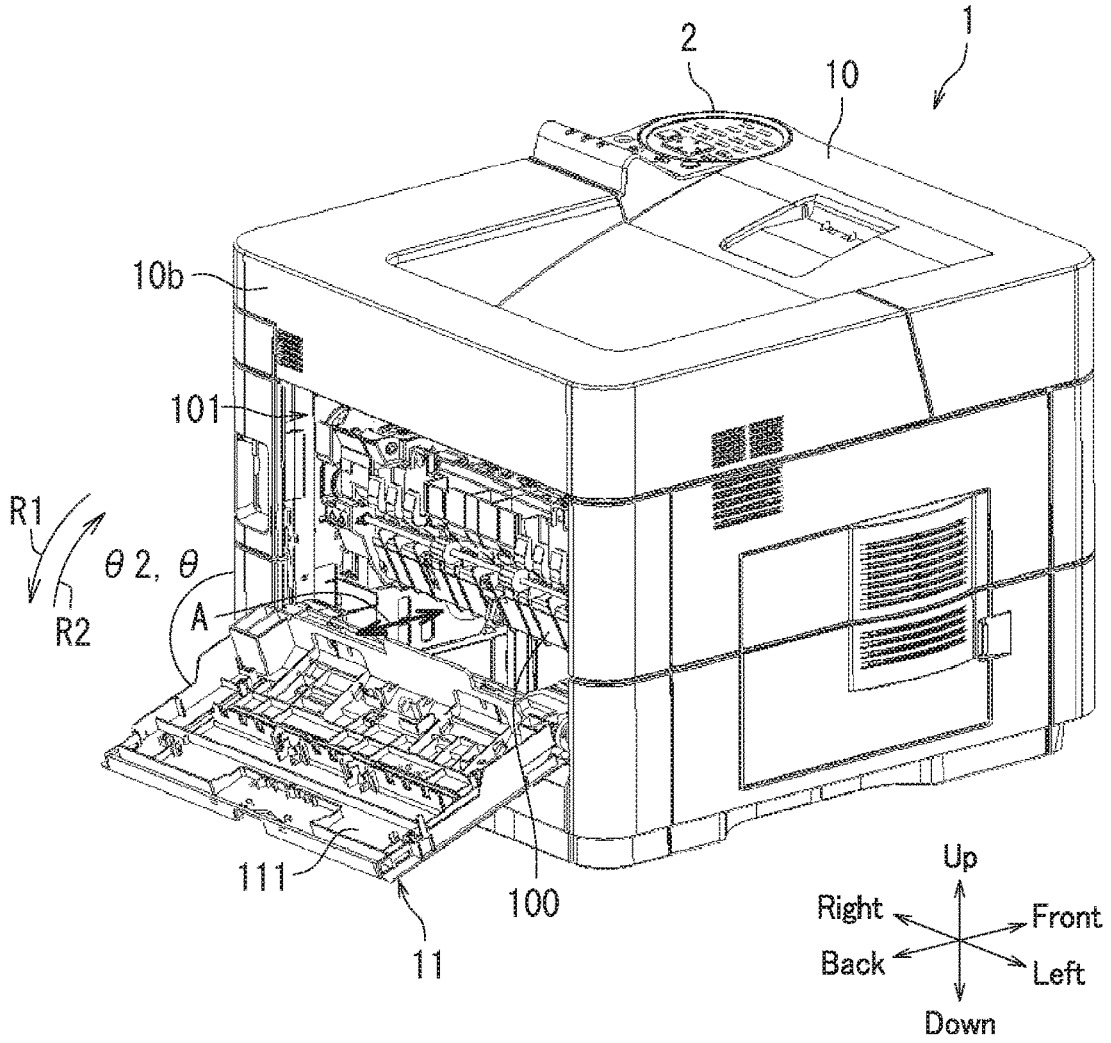
FIG. 3 is a perspective view illustrating a configuration of a first cover member according to the embodiment of the present disclosure.

Next, a configuration of the first cover member 11 according to the present embodiment will be described with reference to FIG. 3. FIG. 3 is a perspective view illustrating the configuration of the first cover member 11 according to the present embodiment. Specifically, FIG. 3 illustrates a state where the first cover member 11 is open and the second cover member 12 is closed.

As illustrated in FIG. 3, the first cover member 11 includes a first cover main body 111. The first cover main body 11 is a flat plate-like member that covers the first opening 101. That is, the first opening 101 is covered by the first cover main body 111 when the first cover main body 111 is closed. The first cover member 11 illustrated in FIG. 3 is rotated up to a second rotation angle θ2 that is larger than the first rotation angle θ1. In other words, restriction of the allowable rotation angle $\theta_A$ by the rotation angle restricting member is released. The second rotation angle θ2 in the present embodiment is for example 90 degrees. The operator can attach the fixing device 100 to the inside of the housing 10 and detach the fixing device 100 from the inside of the housing 10 via the first opening 101 by rotating the first cover member 11 up to the second rotation angle θ2. Specifically, the operator can attach the fixing device 100 to the inside of the housing 10 and detach the fixing device 100 from the inside of the housing 10 by moving the fixing device 100 in directions indicated by an arrow A in FIG. 3. Note that the second rotation angle θ2 is not limited to 90 degrees. It is only required that the second rotation angle θ2 is no less than 90 degrees.

Figure 4A:
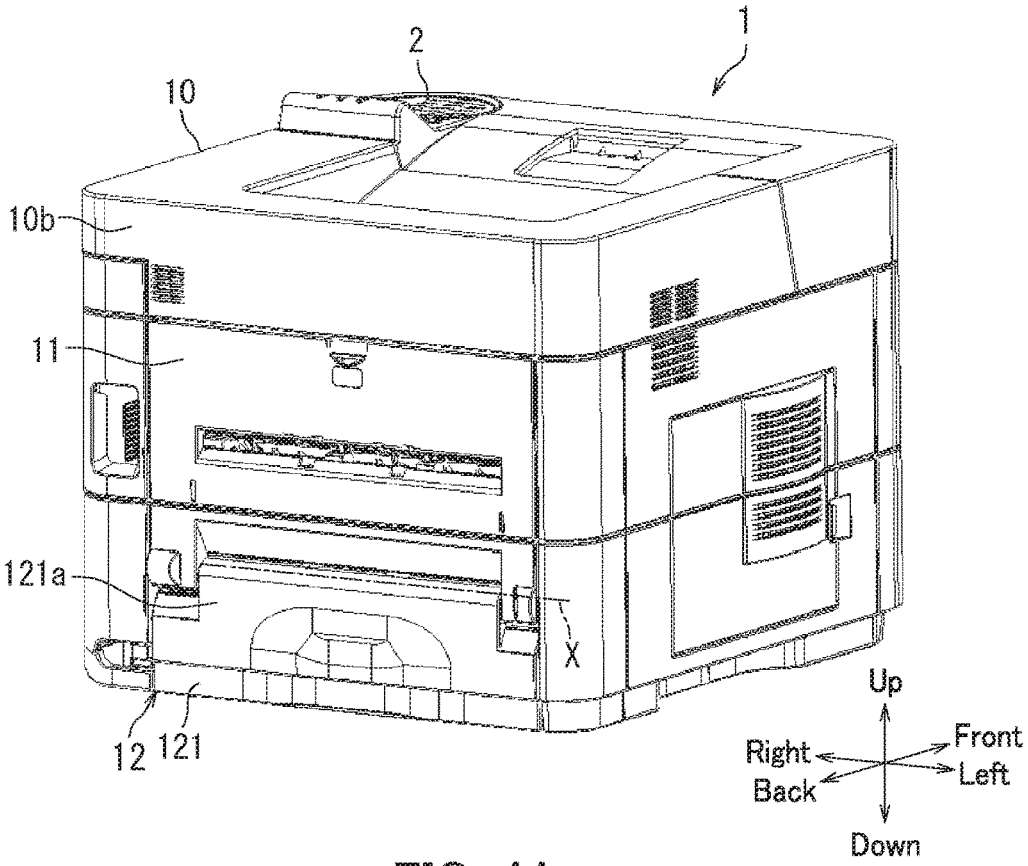
FIG. 4A is a perspective view illustrating a configuration of a second cover member according to the embodiment of the present disclosure.
Figure 4B:
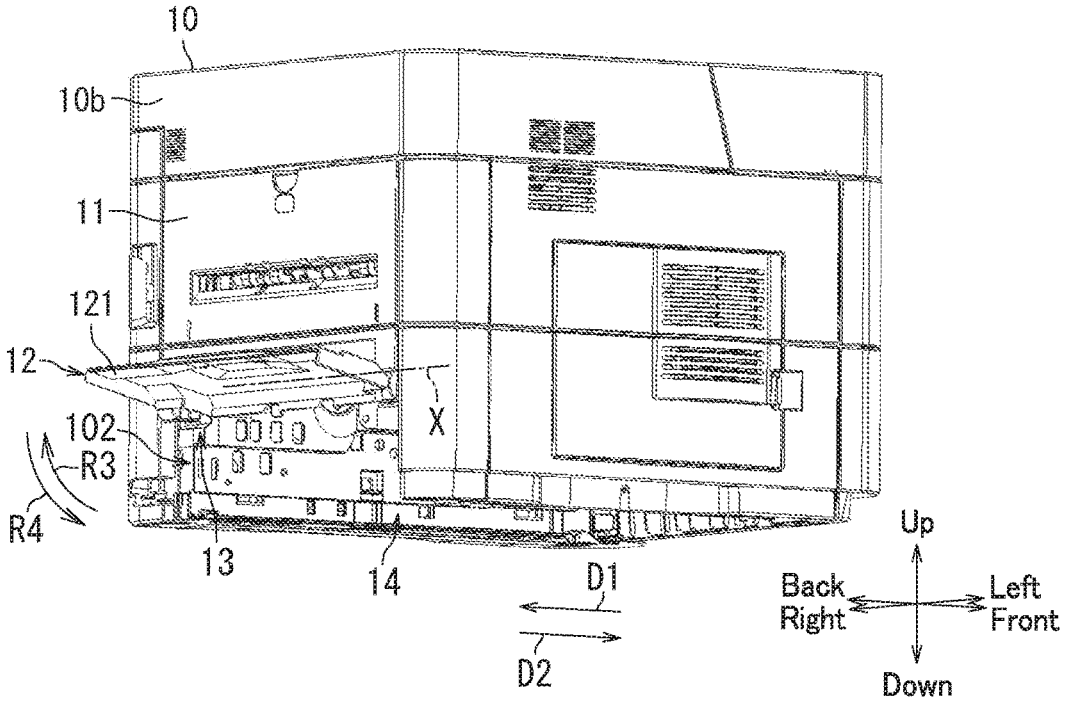
FIG. 4B is a perspective view illustrating the configuration of the second cover member according to the embodiment of the present disclosure.

The following describes a configuration of the second cover member 12 according to the present embodiment with reference to FIGS. 4A and 4B. FIGS. 4A and 4B are perspective views illustrating the configuration of the second cover member 12 according to the present embodiment. Specifically, FIG. 4A illustrates a state where the first cover member 11 and the second cover member 12 are closed, and FIG. 4B illustrates a state where the first cover member 11 is closed and the second cover member 12 is open. Note that the cassette 31 described with reference to FIG. 1 is detached from the housing 10 of the image forming apparatus 1 illustrated in FIG. 4B.

As illustrated in FIG. 4A, the second cover member 12 includes a second cover main body 121. The second cover main body 121 is a flat plate-like member that covers the second opening 102. That is, the second opening 102 is covered by the second cover main body 121 when the second cover main body 121 is closed. The second cover main body 121 has a projection 121*a*. The second cover member 12 in the present embodiment rotates about an axis X located at an upper end of the projection 121*a*.

Also, the housing 10 further includes a restricting member attachment section 13 as illustrated in FIG. 4B. The restricting member attachment section 13 in the present embodiment is located on the right side within the housing 10. The rotation angle restricting member is attached to the restricting member attachment section 13.

Also, the housing 10 includes a cassette attachment section 14 in a lower part thereof as illustrated in FIG. 4B. The cassette attachment section 14 is located below the restricting member attachment section 13. The cassette 31 described with reference to FIG. 1 is attached to the cassette attachment section 14 in an attachable and detachable manner. In attachment of the cassette 31 to the cassette attachment section 14, the cassette 31 is moved (slides) in a first movement direction D1 (i.e., from the front side toward the back side of the image forming apparatus 1). In detachment of the cassette 31 from the cassette attachment section 14, the cassette 31 is moved in a second movement direction D2 (i.e., from the back side to the front side of the image forming apparatus 1).

Figure 5A:
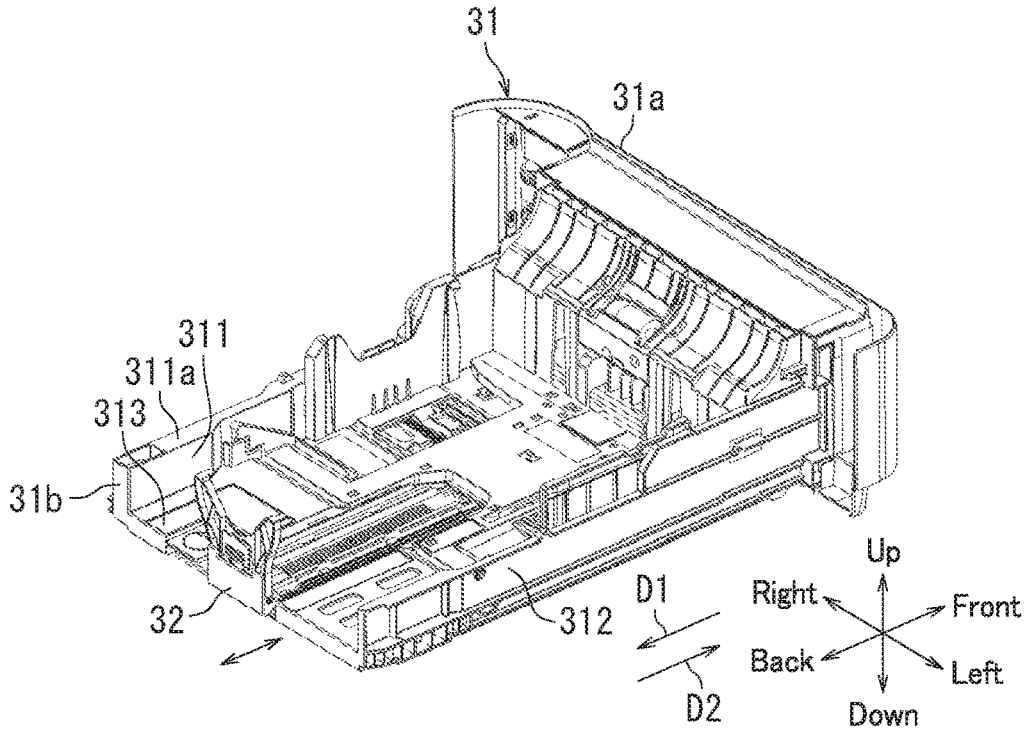
FIG. 5A is a perspective view illustrating a configuration of a cassette according to the embodiment of the present disclosure.
Figure 5B:
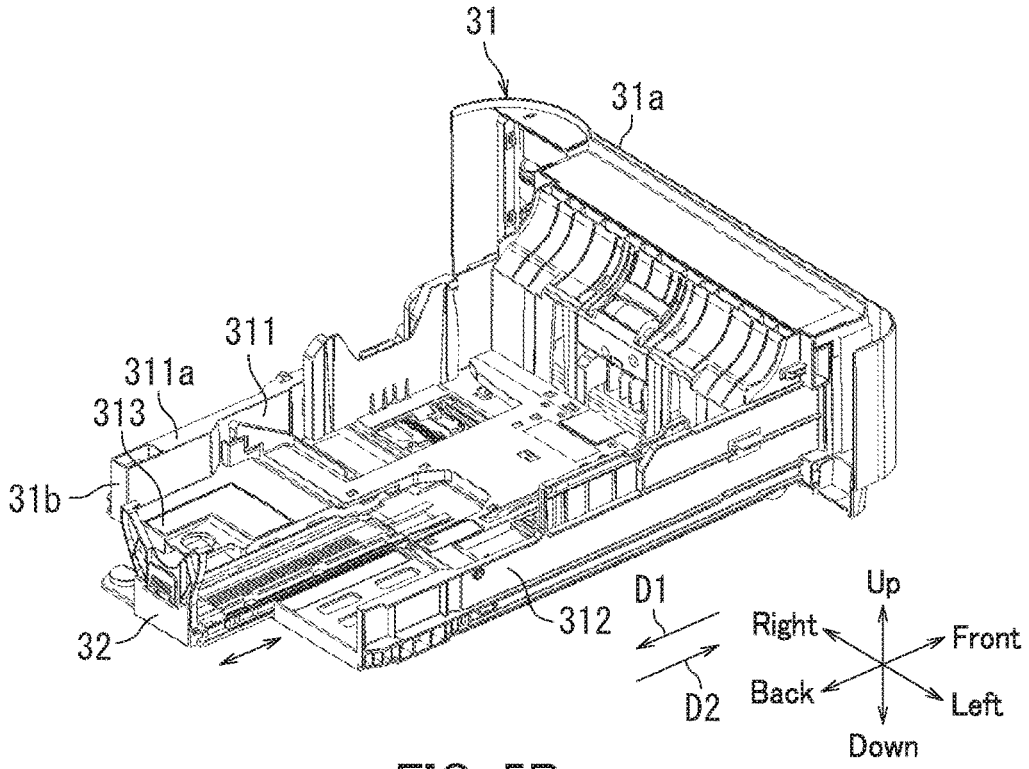
FIG. 5B is a perspective view illustrating the configuration of the cassette according to the embodiment of the present disclosure.

The following describes the cassette 31 according to the present embodiment with reference to FIGS. 5A and 5B. FIGS. 5A and 5B are perspective views illustrating a configuration of the cassette 31 according to the present embodiment.

As illustrated in FIGS. 5A and 5B, the cassette 31 is a box-like member. The cassette 31 has a right wall 311, a left wall 312, and a bottom wall 313 in addition to the edge guide 32 described with reference to FIG. 2B. The right wall 311 has an upper surface 311*a* as an example of a cover surface. Also, the cassette 31 has a back surface 31*b*. The cassette 31 is open on the side where the back surface 31*b* is located. In a state where the cassette 31 is attached to the housing 10 described for example with reference to FIG. 2, the back surface 31*b* of the cassette 31 is located further inside of the housing 10 (front side of the image forming apparatus 1) than the back surface 10*b* of the housing 10.

The edge guide 32 restricts backward movement of sheets accommodated in the cassette 31. The edge guide 32 is supported by the bottom wall 313 so as to be slidable in both the first movement direction D1 and the second movement direction D2 (i.e., forward and backward in the front-back direction of the image forming apparatus 1) illustrated in FIGS. 5A and 5B. A position of the edge guide 32 varies according to a size of sheets accommodated in the cassette 31. For example, when the cassette 31 accommodates A4-size sheets, the edge guide 32 is aligned with the back surface 31*b* of the cassette 31 in the front-back direction, as illustrated in FIG. 5A. By contrast, when the cassette 31 accommodates sheets of a size larger than the A4-size (for example, the legal size), the edge guide 32 is located further backward than the back surface 31*b* of the cassette 31 as illustrated in FIG. 5B.

Figure 6A:
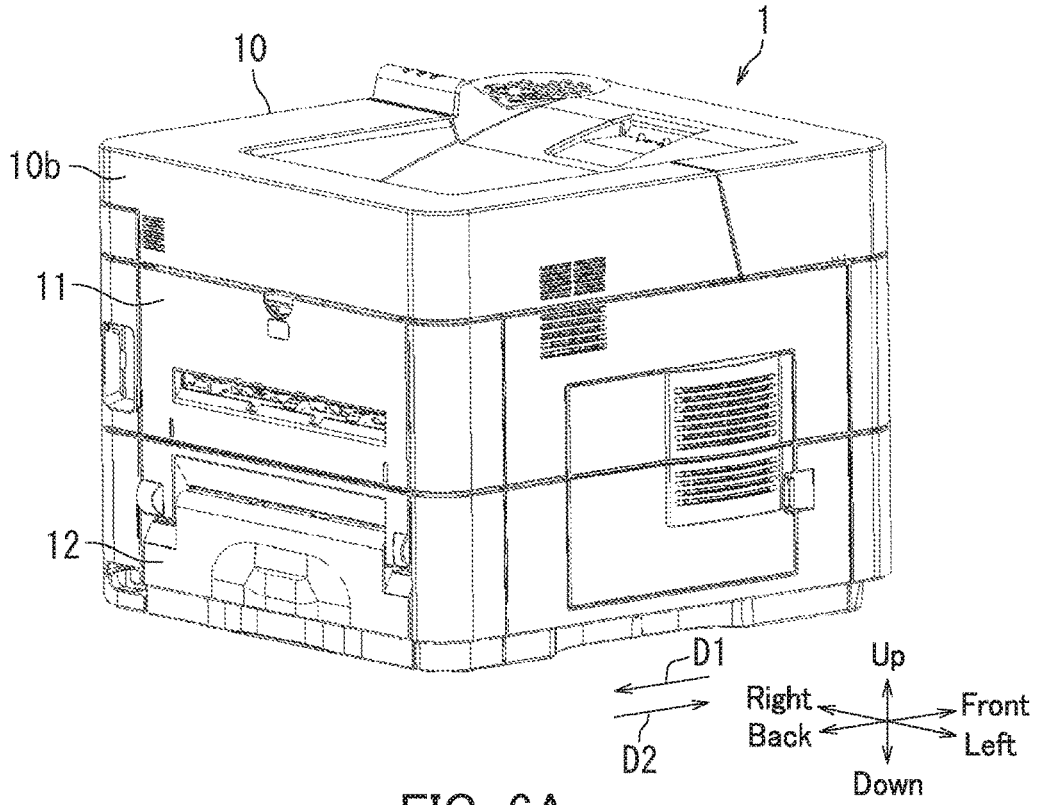
FIG. 6A is a perspective view illustrating the image forming apparatus according to the embodiment of the present disclosure.
Figure 6B:
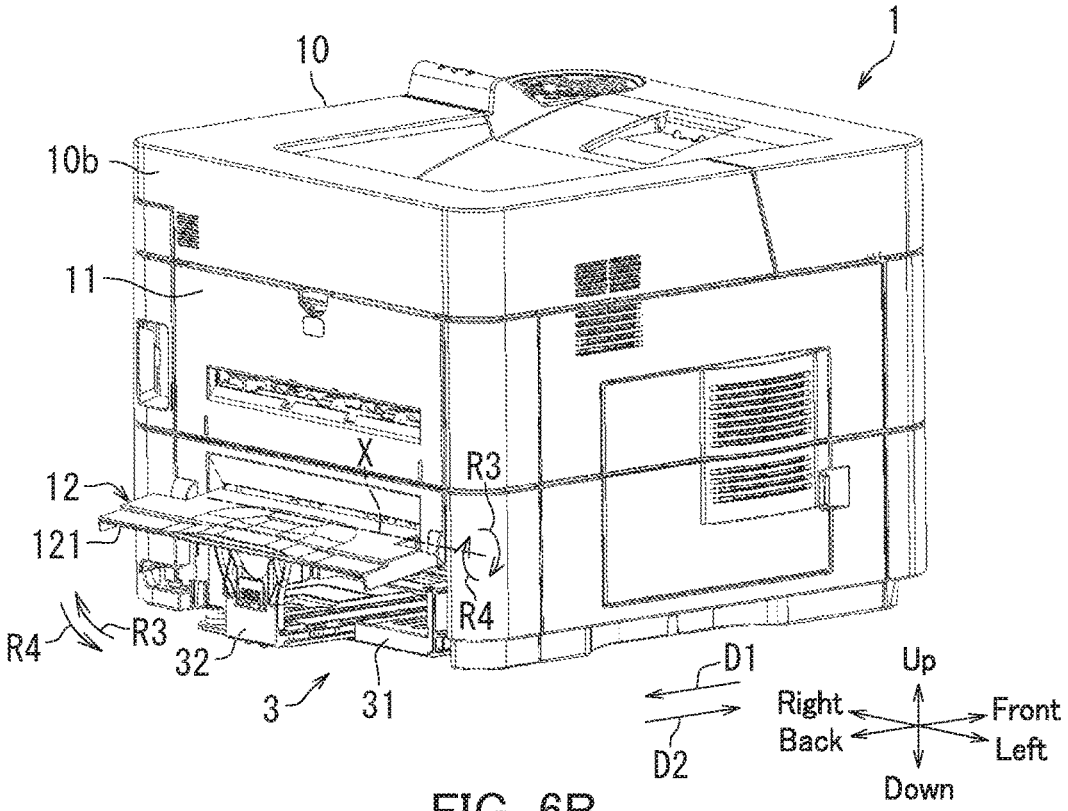
FIG. 6B is a perspective view illustrating the image forming apparatus according to the embodiment of the present disclosure.

FIGS. 6A and 6B are perspective views illustrating the image forming apparatus 1 according to the present embodiment. Specifically, the cassette 31 in the state illustrated in FIG. 5A is attached to the image forming apparatus 1 illustrated in FIG. 6A. The cassette 31 in the state illustrated in FIG. 5B is attached to the image forming apparatus 1 illustrated in FIG. 6B.

When the cassette 31 in the state illustrated in FIG. 5A is attached to the cassette attachment section 14, the edge guide 32 is located further frontward than the back surface 10*b* of the housing 10. Therefore, the second cover member 12 is closed as illustrated in FIG. 6A.

By contrast, when the cassette 31 in the state illustrated in FIG. 5B is attached to the cassette attachment section 14, the edge guide 32 is located further backward than the back surface 10*b* of the housing 10. Therefore, the second cover member 12 is open while being supported from the underside thereof by the edge guide 32, as illustrated in FIG. 6B. Specifically, when the cassette 31 in the state illustrated in FIG. 5B is moved in the first movement direction D1 to be attached to the cassette attachment section 14, the edge guide 32 comes into contact with the second cover main body 121. When the edge guide 32 comes into contact with the second cover main body 121, a backward force is applied to the second cover main body 121. As a result of application of the backward force, the second cover main body 121 rotates about the axis X as a pivot in the third rotation direction R3. Also, the second cover main body 121 is supported from the underside thereof by the edge guide 32. As a result, the second cover member 12 becomes open.

Figure 7:
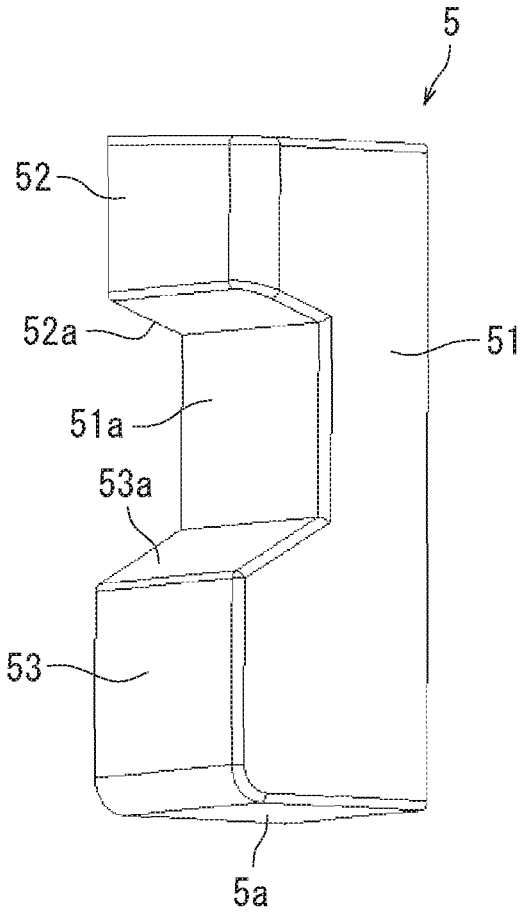
FIG. 7 is a perspective view illustrating an example of a configuration of a rotation angle restricting member according to the embodiment of the present disclosure.

The following describes a configuration of a rotation angle restricting member 5 according to the present embodiment with reference to FIG. 7. The rotation angle restricting member 5 is attached to the restricting member attachment section 13 described with reference to FIG. 4B. FIG. 7 is a perspective view illustrating an example of the configuration of the rotation angle restricting member 5 according to the present embodiment.

As illustrated in FIG. 7, the rotation angle restricting member 5 is a substantially C-shaped member. The rotation angle restricting member 5 has a base 51, a first projection 52, and a second projection 53. The base 51 is substantially in a rectangular parallelepiped shape. The first projection 52 and the second projection 53 are located on the same side of the base 51 and opposite to each other with a space therebetween. The base 51 has a facing surface 51*a* between the first projection 52 and the second projection 53. The first projection 52 has a restriction surface 52*a* meeting with the facing surface 51*a*. The second projection 53 has an inclined surface 53*a* facing the restriction surface 52*a*. The inclined surface 53*a* is inclined such that a point on the inclined surface 53*a* closer to the facing surface 51*a* than another point on the inclined surface 53*a* is closer to the first projection 52 (the restriction surface 52*a*) than the other point on the inclined surface 53*a*. The rotation angle restricting member 5 further has a bottom surface 5*a*. The bottom surface 5*a* is constituted by an end surface of the base 51 and an end surface of the second projection 53. Specifically, the bottom surface 5*a* includes the end surface of an end of the base 51 at which the second projection 53 is provided. Also, the bottom surface 5*a* of the rotation angle restricting member 5 includes the end surface of the second projection 53 that is opposite to the inclined surface 53*a* thereof.

Figure 8:
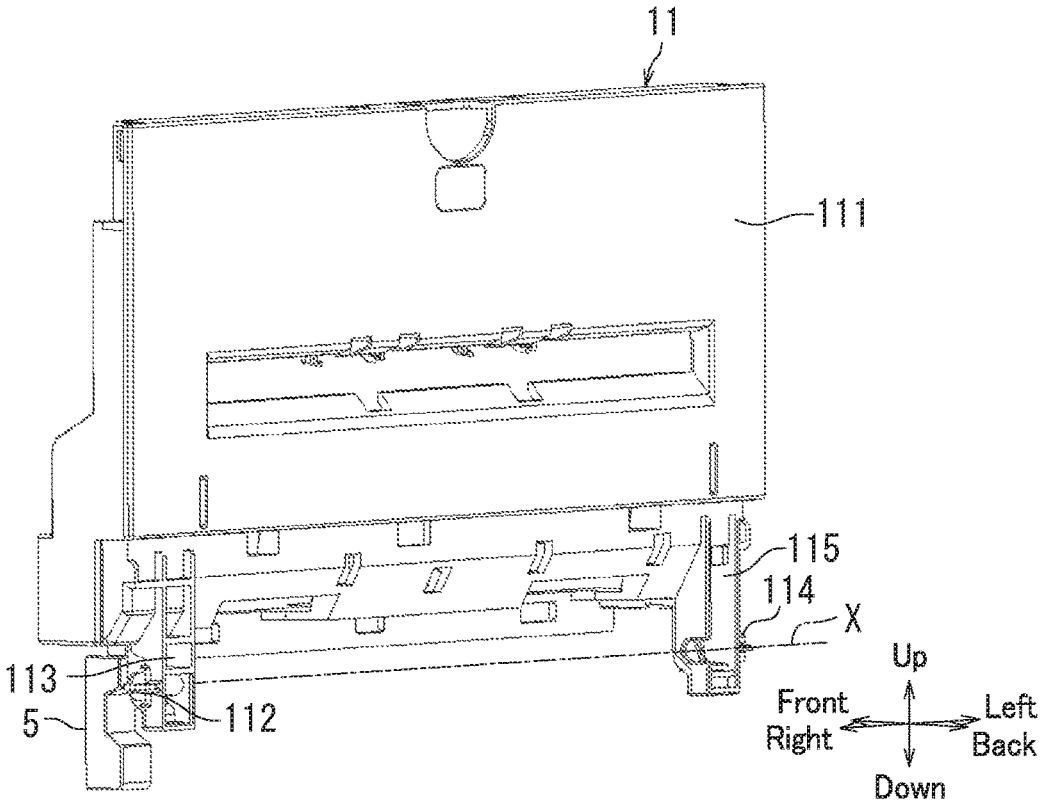
FIG. 8 is a diagram illustrating the first cover member and the rotation angle restricting member according to the embodiment of the present disclosure.

The following describes with reference to FIGS. 8 to 11 a configuration for restricting a rotation angle of the first cover member 11 by the rotation angle restricting member 5 according to the present embodiment. FIG. 8 is a diagram illustrating the first cover member 11 and the rotation angle restricting member 5 according to the present embodiment. Specifically, FIG. 8 illustrates a state where the first cover member 11 is closed.

As illustrated in FIG. 8, the first cover member 11 includes a first pivot portion 112, a first support portion 113, a second pivot portion 114, and a second support portion 115.

The first pivot portion 112 and the second pivot portion 114 are rotatably supported by the housing 10 described for example with reference to FIG. 1. The first pivot portion 112 and the second pivot portion 114 in the present embodiment are each slidably fitted in a corresponding one of two fitting sections of the housing 10. The first pivot portion 112 is joined to a right side surface of the first support portion 113. The first pivot portion 112 projects outwards (i.e., to the right side of the image forming apparatus 1) from the right side surface of the first support portion 113. The second pivot portion 114 is joined to a left side surface of the second support portion 115. The second pivot portion 114 projects outwards (i.e., to the left side of the image forming apparatus 1) from the left side surface of the second support portion 115.

The first support portion 113 in the present embodiment is joined to a right end position of a base end of the first cover main body 111. The second support portion 115 is joined to a left end position of the base end of the first cover main body 111. In a state where the first cover main body 111 is closed, the first support portion 113 and the second support portion 115 project downwards from the base end of the first cover main body 111. Note that the base end of the first cover main body 111 is a lower end of the first cover main body 111 in a state where the first cover member 11 is closed.

The first cover main body 111 is rotatable about the first pivot portion 112 and the second pivot portion 114 in both the first rotation direction R1 and the second rotation direction R2 described with reference to FIG. 2B. As a result of rotation of the first cover main body 111 in the first rotation direction R1 or the second rotation direction R2, the first cover member 11 is opened or closed. Note that an axis of the first cover member 11 in the present embodiment is the same as the axis X of the second cover member 12 (the second cover main body 121) described with reference to FIG. 6B.

Figure 9:
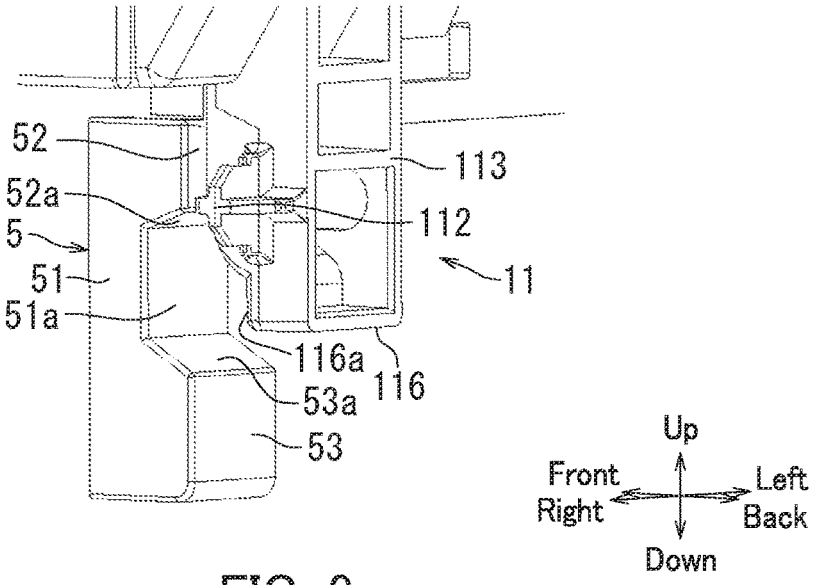
FIG. 9 is an enlarged view illustrating the vicinity of the rotation angle restricting member illustrated in FIG. 8.

FIG. 9 is an enlarged view illustrating the vicinity of the rotation angle restricting member 5 illustrated in FIG. 8. As illustrated in FIG. 9, the first cover member 11 further includes an abutment portion 116. The abutment portion 116 in the present embodiment is an end of the first support portion 113 (an end far from the first cover main body 111). In other words, the abutment portion 116 is located opposite to the first cover main body 111 with the first pivot portion 112 therebetween.

The abutment portion 116 is located opposite to the rotation angle restricting member 5 attached to the restricting member attachment section 13 described with reference to FIG. 4B. The abutment portion 116 has an abutment surface 116*a* facing the rotation angle restricting member 5. The abutment surface 116*a* faces the facing surface 51*a* of the rotation angle restricting member 5 in a state where the first cover member 11 is closed.

Figure 10:
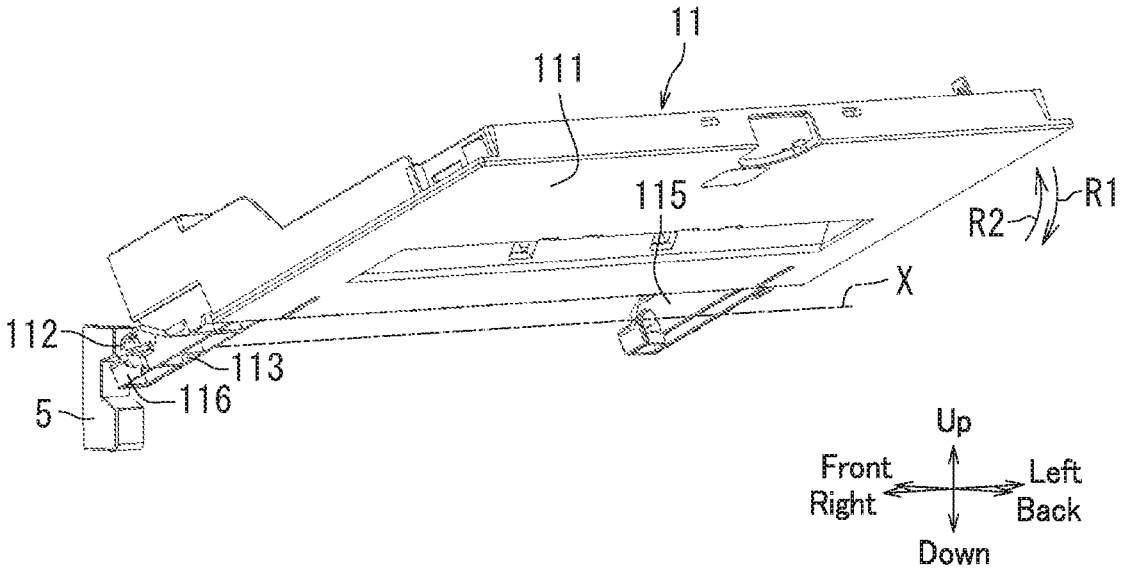
FIG. 10 is a diagram illustrating the first cover member and the rotation angle restricting member according to the embodiment of the present disclosure.
Figure 11:
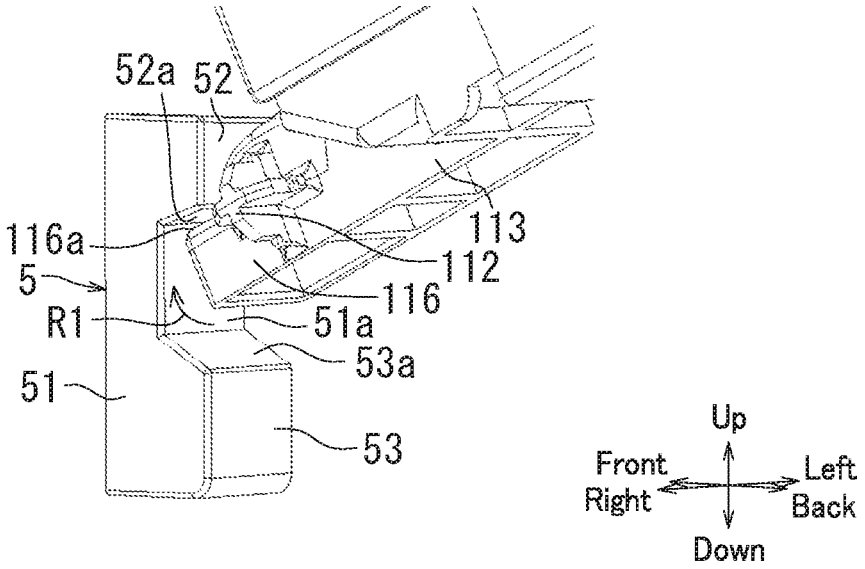
FIG. 11 is an enlarged view illustrating the vicinity of the rotation angle restricting member illustrated in FIG. 10.

The following further describes the first cover member 11 and the rotation angle restricting member 5 in a state where the first cover member 11 is open with reference to FIGS. 10 and 11.

FIG. 10 is a diagram illustrating the first cover member 11 and the rotation angle restricting member 5 according to the present embodiment. FIG. 11 is an enlarged view illustrating the vicinity of the rotation angle restricting member 5 illustrated in FIG. 10.

As illustrated in FIG. 10, when the first cover member 11 rotates in the first rotation direction R1, the abutment portion 116 abuts on the rotation angle restricting member 5. Specifically, the abutment surface 116*a* described with reference to FIG. 9 abuts on the restriction surface 52*a* of the rotation angle restricting member 5, as illustrated in FIG. 11. As a result, rotation of the abutment portion 116 (the first cover member 11) in the first rotation direction R1 is restricted. In other words, the allowable rotation angle $\theta_A$ of the first cover member 11 is restricted within a range of no less than 0 degree and no greater than the first rotation angle θ1.

Figure 12A:
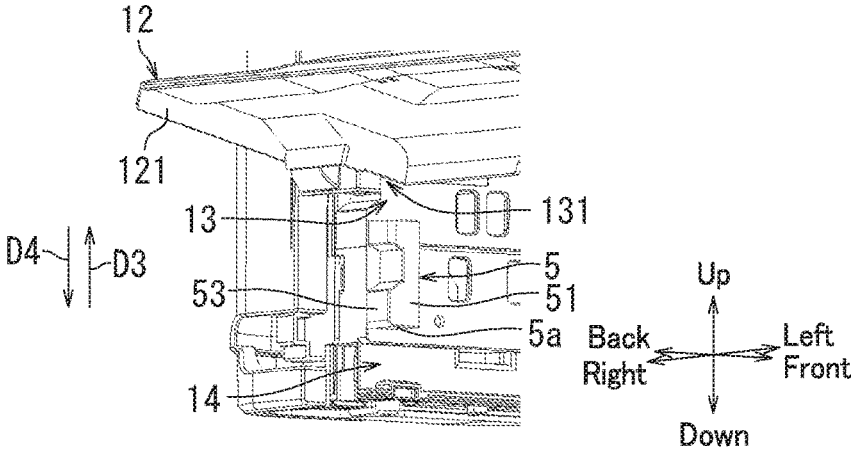
FIG. 12A is a diagram illustrating a method for attaching the rotation angle restricting member according to the embodiment of the present disclosure.
Figure 12B:
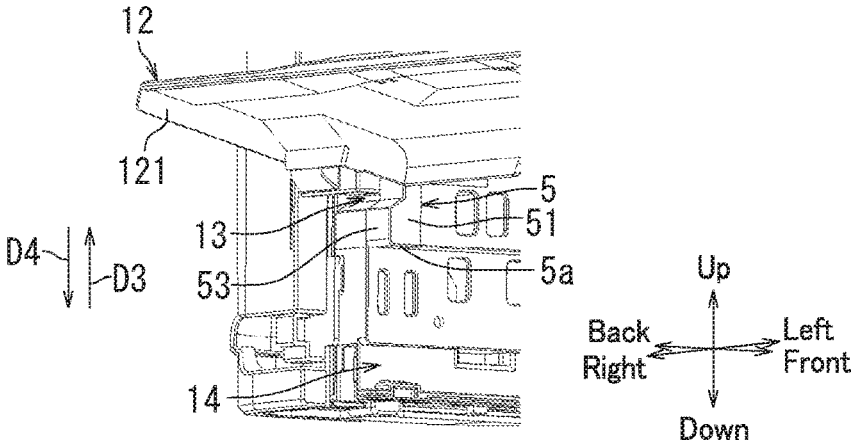
FIG. 12B is a diagram illustrating the method for attaching the rotation angle restricting member according to the embodiment of the present disclosure.
Figure 12C:
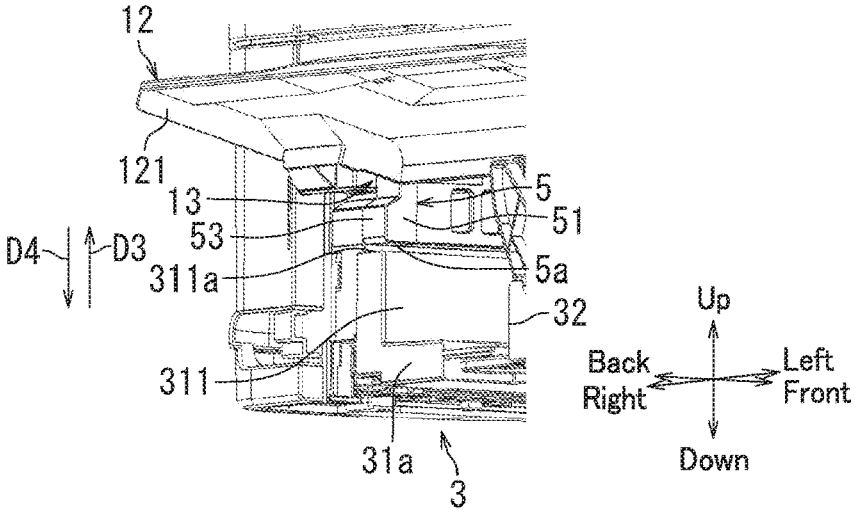
FIG. 12C is a diagram illustrating the method for attaching the rotation angle restricting member according to the embodiment of the present disclosure.

The following describes a method for attaching the rotation angle restricting member 5 to the restricting member attachment section 13 with reference to FIGS. 12A, 12B, and 12C. FIGS. 12A, 12B, and 12C are diagrams illustrating the method for attaching the rotation angle restricting member 5 according to the present embodiment. FIGS. 12A, 12B, and 12C are enlarged views illustrating the vicinity of the restricting member attachment section 13 illustrated in FIG. 4B.

As illustrated in FIG. 12A, the restricting member attachment section 13 has an attachment port 131. The rotation angle restricting member 5 is moved in a third movement direction D3 (a direction from the lower side to the upper side of the image forming apparatus 1) to be inserted into the restricting member attachment section 13 via the attachment port 13.

Specifically, a portion of the rotation angle restricting member 5 is attached to the restricting member attachment section 13 as illustrated in FIG. 12B. The rotation angle restricting member 5 inserted into the restricting member attachment section 13 is supported by (i.e., fixed to) the restricting member attachment section 13 for example by snap fit (elastic force).

Thereafter, when the cassette 31 described with reference to FIGS. 5A and 5B is attached to the cassette attachment section 14 as illustrated in FIG. 12C, the upper surface 311*a* of the right wall 311 of the cassette 31 is located opposite to the attachment port 131. That is, the upper surface 311*a* of the right wall 311 of the cassette 31 faces the bottom surface 5*a* of the rotation angle restricting member 5. As a result of the upper surface 311*a* of the right wall 311 of the cassette 31 facing the bottom surface 5*a* of the rotation angle restricting member 5, movement of the rotation angle restricting member 5 in a fourth movement direction D4 (a direction from the upper side to the lower side of the image forming apparatus 1) is restricted. As a result, detachment of the rotation angle restricting member 5 is restricted. Note that the third movement direction D3 and the fourth movement direction D4 (an example of a second attachment direction) are perpendicular to the first movement direction D1 and the second movement direction D2 (an example of a first attachment direction) described with reference to FIGS. 4B, 5A, and 5B.

When the cassette 31 is detached from the cassette attachment section 14, the rotation angle restricting member 5 can be detached from the restricting member attachment section 13. In detachment of the rotation angle restricting member 5, the operator holds a portion of the rotation angle restricting member 5 projecting from the restricting member attachment section 13 (the attachment port 131) with fingers and moves the rotation angle restricting member 5 in the fourth movement direction D4. Typically, the operator pulls down the rotation angle restricting member 5 by hooking a finger over the second projection 53 of the rotation angle restricting member 5. As a result, the rotation angle restricting member 5 is detached from the restricting member attachment section 13. When the rotation angle restricting member 5 is detached from the restricting member attachment section 13, restriction of the rotation angle θ (the allowable rotation angle $\theta_A$) of the first cover member 11 is released.

Through the above, the embodiment of the present disclosure has been described. According to the present embodiment, the rotation angle θ of the first cover member 11 can be restricted. Also, the restriction of the rotation angle θ of the first cover member 11 can be released. Specifically, when the rotation angle restricting member 5 is attached to the housing 10 (the restricting member attachment section 13), the allowable rotation angle $\theta_A$ of the first cover member 11 is restricted within a range of no less than 0 degree and no greater than the first rotation angle θ1. Therefore, damage to the first cover member 11 and/or the second cover member 12, which would be caused by interference between the first cover member 11 and the second cover member 12, can be prevented. When the rotation angle restricting member 5 is detached from the housing 10 (the restricting member attachment section 13), the restriction of the rotation angle θ of the first cover member 11 is released. Therefore, the fixing device 100 can be replaced without removing the first cover member 11.

Also, according to the present embodiment, the second cover member 12 is supported by the edge guide 32 when the second cover member 12 is open. When the first cover member 11 further rotates up to the second rotation angle θ2 in the above state, not only the second cover member 12 but also the edge guide 32 may be damaged. However, according to the present embodiment, when the allowable rotation angle $\theta_A$ of the first cover member 11 is restricted within a range of no less than 0 degree to no greater than the first rotation angle θ1, the first cover member 11 does not interfere with the second cover member 12. Therefore, damage to the edge guide 32 can be prevented. Further, according to the present embodiment, the rotation angle restricting member 5 cannot be detached when the cassette 31 is attached. Therefore, a possibility of unintentional detachment of the rotation angle restricting member 5 can be reduced.

Also, according to the present embodiment, the detachment of the rotation angle restricting member 5 is restricted by the side wall of the cassette 31. Therefore, an increase in the number of components can be suppressed.

Also, according to the present embodiment, the second projection 53 of the rotation angle restricting member 5 has the inclined surface 53*a*. The above configuration enlarges a space for hooking the finger of the operator over the second projection 53, making it easy to detach the rotation angle restricting member 5.

Further, according to the present embodiment, the end of the first support portion 113 serves as the abutment portion 116. Therefore, an increase in the number of components can be suppressed.

Note that although the present embodiment has been described about a case where the rotation angle restricting member 5 is a substantially C-shaped member, the rotation angle restricting member 5 may for example be a substantially L-shaped member. In other words, the second projection 53 may be omitted.

Further, although the present embodiment has been described about a case where the restricting member attachment section 13 is provided on the right side of the housing 10, the restricting member attachment section 13 may be provided on the left side of the housing 10. Alternatively, the restricting member attachment section 13 may be provided on both the right and left sides of the housing 10. In this case, the number and location of the abutment portions 116 are changed according to the number and location of the restricting member attachment sections 13.

Also, although the present embodiment has been described about a case where the attachable and detachable device is the fixing device 100, the attachable and detachable device may for example be a photosensitive drum.

Also, although the present embodiment has been described about a case where the detachment restricting member is the cassette 31, the detachment restricting member may for example be a plate-like member slidably supported by the housing 10. The plate-like member is located opposite to the attachment port 131 to restrict detachment of the rotation angle restricting member 5 from the restricting member attachment section 13.

Through the above, the embodiment of the present disclosure has been described with reference to the drawings (FIGS. 1 to 12). However, the present disclosure is not limited to the above embodiment and is practicable in various manners within a scope not departing from the gist of the present disclosure. Also, the numerical values described in the above embodiment are merely examples and are not intended as specific limitations. Various alterations may be made within a scope not substantially departing from the effects of the present disclosure.

For example, although the embodiment of the present disclosure has been described about a case where the image forming apparatus 1 is a printer, the image forming apparatus 1 may for example be a multifunction peripheral or a copier.

What is claimed is:

1. An image forming apparatus comprising:

a housing having an opening and an attachment section;

an attachable and detachable device attachable to and detachable from an inside of the housing via the opening;

a cover member rotatably supported by the housing and configured to close or open the opening;

a rotation angle restricting member attachable to and detachable from the attachment section and configured to restrict an allowable rotation angle that indicates an angle at which the cover member is rotatable; and a detachment restricting member configured to restrict detachment of the rotation angle restricting member from the attachment section, wherein the detachment restricting member is attachable to and detachable from the housing, restriction of detachment of the rotation angle restricting member from the attachment section is released when the detachment restricting member is detached from the housing, detachment of the rotation angle restricting member from the attachment section is restricted when the detachment restricting member is attached to the housing, the allowable rotation angle of the cover member is restricted when the rotation angle restricting member is attached to the attachment section, and restriction of the allowable rotation angle of the cover member is released when the rotation angle restricting member is detached from the attachment section.

2. The image forming apparatus according to claim 1, wherein a first attachment direction and a second attachment direction are perpendicular to each other, the first attachment direction being a direction in which the rotation angle restricting member is moved to be attached to the attachment section, and the second attachment direction being a direction in which the detachment restricting member is moved to be attached to the housing.

3. The image forming apparatus according to claim 1, wherein the attachment section has an attachment port into which the rotation angle restricting member is inserted, the detachment restricting member has a cover surface, and when the detachment restricting member is attached to the housing, the cover surface is located opposite to the attachment port.

4. The image forming apparatus according to claim 3, wherein the detachment restricting member is a box-like member, and the detachment restricting member has a side wall having the cover surface.

5. The image forming apparatus according to claim 4, wherein when the detachment restricting member is attached to the housing, the detachment restricting member is located below the rotation angle restricting member, and the cover surface is an upper surface of the side wall of the detachment restricting member.

6. The image forming apparatus according to claim 1, wherein the detachment restricting member is a sheet accommodating device that accommodates a sheet.

7. The image forming apparatus according to claim 6, wherein the sheet accommodating device includes a sheet restricting member that is slidable according to a size of the sheet accommodated in the sheet accommodating device, and the sheet accommodating device is slidable to an outside of the housing.

8. The image forming apparatus according to claim 1, wherein the cover member includes:

a cover main body;

a pivot portion rotatably supported by the housing; and an abutment portion located opposite to the cover main body with the pivot portion therebetween, and when the cover main body rotates in a state where the rotation angle restricting member is attached to the housing, the abutment portion abuts on the rotation angle restricting member to restrict the allowable rotation angle of the cover member.

9. The image forming apparatus according to claim 1, wherein the attachable and detachable device includes a fixing device that fixes an image to a sheet.

* * * * *